US011423724B2

(12) United States Patent
Gomez Santamaria et al.

(10) Patent No.: US 11,423,724 B2
(45) Date of Patent: Aug. 23, 2022

(54) METHOD AND SYSTEM FOR ACTIVATING ELECTRONIC LOCKERS

(71) Applicant: OJMAR, S.A., Elgoibar (ES)

(72) Inventors: Diego Gomez Santamaria, Vitoria (ES); Mikel Salozabal Ibarra, Zumaia (ES)

(73) Assignee: OJMAR, S.A., Elgoibar (ES)

( * ) Notice: Subject to any disclaimer, the term of this patent is extended or adjusted under 35 U.S.C. 154(b) by 57 days.

(21) Appl. No.: 16/774,557

(22) Filed: Jan. 28, 2020

(65) Prior Publication Data

US 2020/0410797 A1 Dec. 31, 2020

(30) Foreign Application Priority Data

Nov. 29, 2018 (ES) ..... ES201831160

(51) Int. Cl.
*G07C 9/00* (2020.01)
*E05B 47/00* (2006.01)

(52) U.S. Cl.
CPC ..... *G07C 9/00912* (2013.01); *E05B 47/0001* (2013.01); *G07C 9/00571* (2013.01)

(58) Field of Classification Search
CPC ..... G07C 9/00
See application file for complete search history.

(56) References Cited

U.S. PATENT DOCUMENTS

| | | | | |
|---|---|---|---|---|
| 8,854,184 | B2 * | 10/2014 | Mullin | G06Q 30/0645 340/5.81 |
| 9,542,784 | B2 * | 1/2017 | O'Toole | G07C 9/00912 |
| 9,558,608 | B2 * | 1/2017 | Amdahl | G07F 17/12 |
| 10,096,183 | B2 * | 10/2018 | Nitu | H04W 4/80 |
| 2014/0375422 | A1 | 12/2014 | Huber et al. | |
| 2015/0356801 | A1 | 12/2015 | Nitu et al. | |
| 2017/0236350 | A1 | 8/2017 | Lin | |
| 2018/0122170 | A1 | 5/2018 | O'Toole et al. | |

OTHER PUBLICATIONS

Search Report for Corresponding Spanish Patent Application No. 201831160 (dated Apr. 29, 2019) (7 pages).

* cited by examiner

*Primary Examiner* — K. Wong
(74) *Attorney, Agent, or Firm* — Lucas & Mercanti, LLP

(57) ABSTRACT

A method and system for activating electronic lockers is provided which is carried out by sending to a central access control unit an access request for at least one locker operated with an electronic lock; generating an access license which includes a user profile and the identifier of at least one electronic lock; obtaining, through an application of a mobile device, the contents of the access license; manually activating the electronic lock; detecting the activation and sending, with the electronic lock, a BLE signal containing an identifier of the electronic lock; automatically pairing through the BLE, the mobile device with the electronic lock; and wirelessly operating, through the BLE communication and the application of the mobile device, the previously-paired electronic lock.

16 Claims, 3 Drawing Sheets

METHOD AND SYSTEM FOR ACTIVATING ELECTRONIC LOCKERS

CROSS REFERENCE TO RELATED APPLICATION

This application claims the benefit of priority of Spanish Patent Application No. P201831160, filed on Nov. 29, 2018, application which is incorporated herein in its entirety for all purposes.

FIELD OF THE INVENTION

The present invention falls within the field of methods and systems for operating lockers, cabinets or furniture equipped with electronic locks which are installed in public or private spaces, such as gyms, swimming pools, sports centres and offices.

BACKGROUND OF THE INVENTION

Currently, many public and private spaces are equipped with electronic lockers (i.e., lockers operated by means of electronic locks) so that the users can temporarily store their personal effects. Electronic locks are actuated, in most cases, by means of a keypad or an RFID tag.

The powering of the electronic components of the locks can be performed by cable or in a local and insulated manner, by means of a battery installed in each electronic lock. In order to prevent the laborious and complicated process of powering by cable each locker of the facility, it is preferable to power the electronic locks in an individual manner by means of batteries.

Within the systems for controlling and activating battery-powered electronic lockers, the system disclosed in Spanish utility model ES1147183-U is known, which enables considerable energy savings in the batteries by maintaining the electronics of the lock in a standby mode (very low consumption) and periodically energising the antenna of an RFID/NFC reader installed in the lock in order to detect an RFID/NFC card of a user which is brought near it and then waking up the electronic lock. However, this system only envisages the use of RFID/NFC communication, such that the users need a special card to be able to operate the locks, since not all smartphones had by users have NFC technology.

The present invention has a system and an activation method which adds a form of activation which can be used by any smartphone, maintaining a very low level of consumption of the internal battery of the lock. Thus, it is not necessary to provide the user with additional means for actuating the lockers, such as RFID wristbands or cards.

SUMMARY OF THE INVENTION

The present invention relates to a system and a method for activating electronic lockers which is energy-efficient, wherein the activation of the electronic locks is performed by means of a mobile device (i.e., smartphone, smart watch) with Bluetooth Low Energy communication (BLE).

An application installed in the mobile device enables different actions to be performed in the electronic lock:

- Opening or closing the lock.
- Warning of the charge level of the battery if the battery is low.
- Automatically setting the time of the lock.

The method for activating electronic lockers comprises the following steps:

- Electronically sending to a central access control unit an access request for at least one locker operated with an electronic lock, wherein the access request includes a user profile.
- Generating, with the central access control unit, an access licence in order to operate the electronic lock of at least one locker, wherein the access licence includes the user profile and at least one static access key which includes the identifier of the electronic lock of at least one locker.
- Obtaining, by means of an application of the mobile device, the contents of the access licence.
- Activating an electronic lock of a locker. The activation of the electronic lock is preferably performed manually by a user by means of an interaction with a sensor of the electronic lock. The sensor of the electronic lock can be, among others, an LPCD sensor, a capacitive sensor or an infrared sensor. In another embodiment, the activation of the electronic lock is performed by means of a Bluetooth signal (in order to save battery, the electronic lock is periodically woken up in order to receive an activation signal by means of Bluetooth).
- Detecting said activation and sending, with the electronic lock as a response to the detected activation, a BLE signal containing an identifier of the electronic lock.
- Automatically pairing by means of BLE the mobile device with the electronic lock. The pairing is preferably performed by means of an encrypted handshake, although it can also be performed by using a BLE pairing pin included in the access licence.
- Wirelessly operating, by means of BLE communication through the application of the mobile device, the electronic lock of the previously-paired locker.

The electronic sending of the access request which can be performed by a control unit. The method can additionally comprise: coding, with the central access control unit, the access licence in a two-dimensional code; sending, with the central access control unit, the two-dimensional code to the control unit; displaying, with the control unit, the two-dimensional code on a screen; capturing, by using a camera of the mobile device, the two-dimensional code; and decoding the information contained in the two-dimensional code captured in order to obtain the contents of the access licence.

In another embodiment, the electronic sending of the access request and the obtaining of the access licence with the mobile device is performed through a wireless communication with the central access control unit.

The status of the electronic lockers can be accessible to the central access control unit. In this case, the method may comprise: sending, with the central access control unit, a representative image of the lockers and the possibility that they are occupied or not; and representing, on the screen of the mobile device, said image.

The electronic lock of each locker is preferably powered by means of a battery. In this case, the wireless operation of the electronic lock of the locker may comprise: obtaining, with the mobile device, the charge level of the battery; and checking, with the mobile device, whether the charge level of the battery is lower than a certain threshold, and in which case sending a low battery warning.

In one embodiment, the electronic lock of each locker is equipped with an internal clock, and the wireless operation of the electronic lock of the locker comprises: obtaining, with the mobile device, the time of the internal clock of the electronic lock; comparing, with the mobile device, the time of the internal clock of the electronic lock with the time of the clock of the mobile device; and if the difference between both times is greater than a certain threshold, sending to the electronic lock an updated time in order to update the internal clock thereof.

Another aspect of the present invention relates to a system for activating electronic lockers. The system comprises:

- A plurality of electronic locks installed in lockers of a facility, wherein each electronic lock has a BLE communications module and a control module configured to detect an activation of the lock and to send, in response to said detected activation, a BLE signal containing an identifier of the electronic lock.
- A central access control unit configured to, upon receiving an access request including a user profile to operate at least one electronic lock, generate and send an access licence including the user profile and at least one static access key which includes the identifier of the electronic lock of at least one locker;
- A mobile device (for example, a smartphone or a smart watch) configured to obtain the contents of the access licence; establish a pairing by means of BLE with the electronic lock; wirelessly operate, by means of BLE communication, the previously-paired electronic lock.

According to one embodiment, each electronic lock has a sensor configured to detect the activation of the lock by means of an interaction with the sensor performed by a user. The sensor of each electronic lock can be, among others, an LPCD sensor, a capacitive sensor or an infrared sensor. In another embodiment, the control module is configured to detect the activation of the electronic lock by means of receiving a Bluetooth signal.

The system may comprise a control unit configured to electronically send the access request to the central access control unit. The mobile device is preferably configured to establish wireless communication with the central access control unit in order to send the access request and obtain the access license.

Each electronic lock can be configured to communicate the status of the electronic lock to the central access control unit through a Wi-Fi communications module. The central access control unit is preferably configured to send, by means of a Wi-Fi communication established with the mobile device, a representative image of the lockers and the possibility that they are occupied or not, the mobile device being configured to represent said image on the screen.

The energy savings in the present invention are very relevant, such that the useful life of the internal battery of the electronic lock can exceed 2 years.

Apart from the activation by means of mobile device using BLE communication, the electronic lock may include other access means through which the lock is operated. For example, the user can operate the lock using an RFID card or a keypad.

BRIEF DESCRIPTION OF THE DRAWINGS

What follows is a very brief description of a series of drawings that aid in better understanding the invention, and which are expressly related to an embodiment of said invention that are presented by way of non-limiting example of the same.

DETAILED DESCRIPTION OF THE INVENTION

Figure 1:
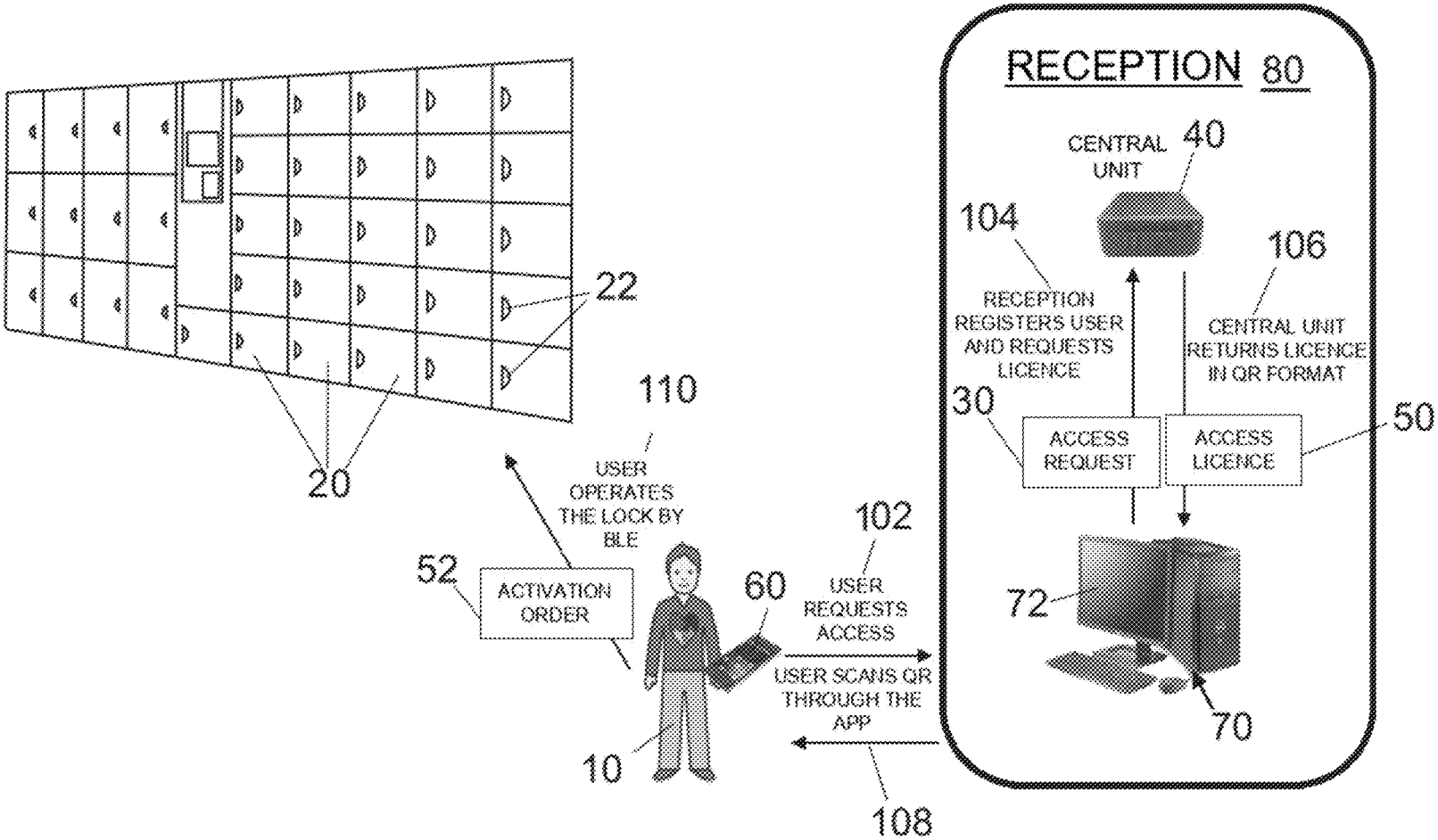
FIG. 1 shows an embodiment of the process for activating electronic lockers using a mobile device of a user and control equipment located in the very facility.

FIG. 1 shows, according to one embodiment of the present invention, a method for controlling electronic lockers. In the method represented in FIG. 1, a user 10 requests 102 access to one or several lockers 20 operated by means of electronic locks 22. The electronic lock 22 of each locker 20 has an electronic control module powered by means of an internal battery.

The lockers 20 can be cubbies or cabinets located in a public or private space, such as gyms, train stations, swimming pools, sports centres, offices, work centres, etc. The request for the locker by the user 10 can be made, for example, personally at the reception 80 of the space or facility where the lockers are located. Said request is received and recorded in a control unit 70 located in the very reception 80. The recording can be performed manually (i.e., by a receptionist) or, alternatively, the request can be sent by the user 10 by using an application installed on a mobile device 60, whereby said request is received and automatically recorded in the control unit 70. The mobile device 60 is a smart portable device, preferably implemented in a smartphone or in a smart watch. The application is adapted to the specific operating system of the mobile device, whether be it Android, iOS, Windows Mobile, Blackberry.

The control unit electronically sends 104 an access request 30 to a central access control unit 40 in order to operate the electronic lock 22 of a locker 20. The central access control unit 40 can be located, as shown in FIG. 1, in the very reception 80, although it could also be located in a different room of the facility where the lockers 20 are located or even remotely (i.e., in another building, city, country) with connection to the control unit 70 through the Internet. The access request 30 includes the user profile with the identification of the user and the information necessary for the user to be able to operate. The user profile includes the number of enabled free locks that the user 10 can use (free locks being those that are free to use, which do not have a specific user assigned) or the fixed electronic locks 22 (which can be one or several fixed locks, which are assigned to a single specific user) for which the user 10 has permission.

The central access control unit 40 generates an access licence 50 to enable the mobile device 60 of the user 10 to operate one or several lockers 20, depending on the profile of the user. The access licence 50 includes user profile information (i.e. the number of enabled free locks or enabled fixed locks), one or several static access keys for operating the electronic lock or locks 22 of the assigned locker or lockers 20. In one embodiment, the access licence 50 may include a BLE pairing pin in order to be able to establish a Bluetooth connection with the electronic lock 22. The contents of the access licence 50 are subsequently delivered to an app of the mobile device 60 of the user 10. In this manner, the static access key is known by the very lock and by the mobile device 60. The static access key contains the facility number (a number associated with all the locks of the facility where the lockers are located, which is the same in all the locks of the facility) and the lock number or identifier (unique for each electronic lock 22). The static access key is unique for each electronic lock 22 and is stored in an internal memory of the electronic lock 22. The BLE pairing pin, if it is sent in the access licence 50, is preferably the same for all the electronic locks 22 of the facility.

According to a possible embodiment, the central access control unit 40 encodes the access licence 50 in a two-dimensional code, which is sent 106 to the control unit 70 responsible for displaying the two-dimensional code on a screen 72. Using a camera of the mobile device 60, the user 10 captures 108 the two-dimensional code. The application of the mobile device 60 decodes the information contained in the captured two-dimensional code in order to obtain the contents of the access licence 50.

Next, the user 10 manually activates an electronic lock 22 of a locker 20 that they want to use, and for which they have permission according to their user profile. Manual activation can be performed, for example, by means of contact, by bringing a smartphone or a card closer to an LPCD sensor or by bringing their hand, a smartphone or a card closer to a capacitive sensor. Alternatively, the activation can be performed by means of detecting the presence of an infrared sensor installed in the lock, when the user moves closer (when a person moves in front of the lock, it wakes up). The control module of the electronic lock 22 of each locker 20 is normally in low consumption mode ("sleep" or "standby" mode) in order to save battery power, with an average consumption below 50 uA. The activation of the sensor wakes up the control module of the electronic lock 22. Once the electronic lock 22 is woken up by the interaction of the user 10, the electronic lock 22 emits, by using a BLE communications module, a BLE signal containing an identifier of the lock (which is obtained by the control module of the electronic lock 22 accessing the data stored in an internal memory). Then, the mobile device 60 is automatically paired by means of BLE with said electronic lock 22. In this manner, by using the "sleep" mode and a sensor configured to wake up the lock when it detects the interaction with a user (i.e., the presence of a user or the contact of a user), the useful life of the internal battery of the electronic lock 22 can exceed 2 years.

Thereafter, the user 10 can wirelessly operate 110, by means of BLE communication and by using the application of the mobile device 60, the electronic lock 22 of the locker 20. In order to operate the electronic lock 22, the application of the mobile device 60 transmits to the electronic lock 22 an activation order 52 which includes the user profile indicating the permitted locks (i.e., the number of enabled free locks or the enabled fixed locks). The activation order 52 may also include the facility number and other additional information, such as the sub-facility number.

Therefore, there is a first interaction and transfer of the interaction between the electronic lock 22 and the mobile device 60 in order to establish a Bluetooth connection (preferably performed by means of an encrypted handshake) and a subsequent interaction to operate the lock, once the Bluetooth connection is established. In this second case, in order to operate a lock, the mobile sends a byte stream which the lock interprets, enabling or rejecting the operation and responding to the app of the mobile device 60.

The control module of the electronic lock 22 receives the access key by means of BLE and compares it to a key (or a list of keys) stored in a memory. If the access key is stored in memory, the mobile device 60 can wirelessly operate 110 the electronic lock 22 of the locker 20.

The operation of an electronic lock works with an encrypted handshake. The electronic lock 22 generates a dynamic access key (keyD) in each new connection. When the control module of the electronic lock 22 is woken up (by means of the manual activation of the user 10), the control module emits the lock number or identifier. When the mobile device 60 receives the lock number, it already knows what the static access key (keyS) thereof is and it sends a connection establishment request to the electronic lock 22 by means of Bluetooth. The electronic lock 22 encrypts the dynamic access key (keyD) generated with the static access key (keyS) and transmits it by means of Bluetooth. The mobile device 60 decrypts the message with the static access key (keyS) and in this manner it finds out what the generated dynamic access key (keyD) is. Then the mobile device 60 encrypts a message known to both parties (for example, "I am the real app") by using the dynamic access key (keyD) and sends it to the electronic lock 22. The communication is considered valid and thereafter all communication is performed by encrypting it with the dynamic access key (keyD).

Starting from that moment, the user 10 can perform any of the usual operations with an electronic lock which are enabled, such as opening the lock, closing the lock or checking the available use time.

Optionally, instead of using an encrypted handshake, the pairing between devices can be automated by using a BLE pairing pin (obtained in the access licence 50) and the identifier of the lock received in the BLE signal. The BLE pairing pin therefore enables the mobile device 60 to be able to establish a Bluetooth connection with the electronic lock.

The wireless operation of the electronic lock 22 of the locker 20 may also include obtaining, with the mobile device 60, the charge level of the battery powering the electronic lock 22. The charge level is obtained by the control module of the electronic lock 22, and communicated by means of BLE to the mobile device 60, which checks whether the charge level of the battery is below a certain threshold, and in which case it sends a low battery warning. The warning can be an alert message sent, among others, to the very user 10, to a maintenance service, to the central access control unit 40, or to the control unit 70.

The wireless operation of the electronic lock 22 may also comprise obtaining, with the mobile device 60, the time of the internal clock of the electronic lock 22 (the control module of the electronic lock 22 of each locker 20 normally has an internal clock), and the comparison of the time of the internal clock of the electronic lock 22 with the time of the clock of the mobile device 60, such that if the difference between the two times is greater than a certain threshold (i.e., 5 minutes), the mobile device 60 sends an updated time to the electronic lock 22 in order to update the internal clock thereof.

The wireless operation of the electronic lock 22 may also comprise modifying the self-closing parameter of the electronic locks. By means of this parameter, the user can indicate to the electronic lock 22 when it should automatically close (i.e., 1 minute, 10 minutes, 1 hour, etc.).

In one possible embodiment, the central access control unit 40 and the control unit 70 located at the reception 80 are the same entity, for example a computer. According to this embodiment, the process for operating the locker includes the following steps:

The user 10 requests at the reception 80 the use of a locker 20.

The user 10 downloads and installs an application on their mobile device 60.

An operator at the reception 80 generates, using a computer (which functions as the central access control unit 40 and control unit 70), an access licence 50 and transforms it into a two-dimensional code (i.e., QR code) that is displayed on the computer screen.

The application of the mobile device 60 enables the reading of the two-dimensional code and, after the reading, translates it into a licence with all the information necessary so that the application can operate one or several lockers. With this, the user can open/close lockers according to their profile by using the information provided.

The BLE pairing between electronic lock 22 and mobile device 60 is automated (using the operation of the encrypted handshake or a BLE pairing PIN transferred in the licence).

In the case that free lockers are being operated, if the user 10 requests to close a locker but that locker has been closed by another user recently, the application warns the user of the error. The application can ask the user if they have stored their things in that locker, and if so, it will indicate that it warns the reception.

Figure 2:
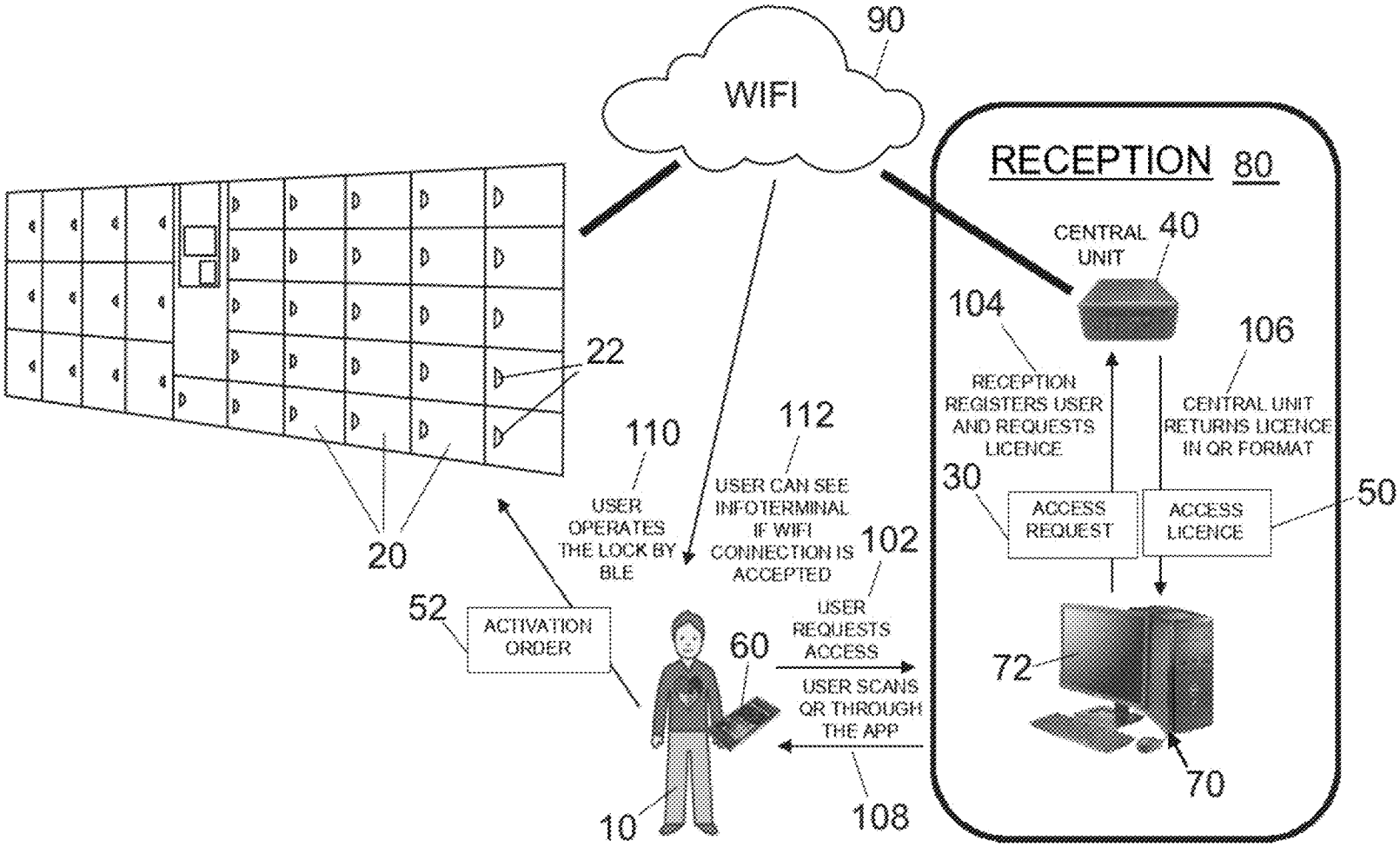
FIG. 2 represents a process for activating electronic lockers similar to the one shown in FIG. 1, with the particularity of including a Wi-Fi connection with the lockers in order to know the current status thereof (occupied/free).

The user also has the option of accessing information about the lockers of the facility, for which reason the connection to the Wi-Fi network of the facility is required (as shown in FIG. 2 below). If the user accepts the Wi-Fi connection, the application automatically displays on the screen the information about the free and closed lockers of the facility.

The embodiment of FIG. 2 is identical to the one shown in FIG. 1 with the exception that the central access control unit 40 has a direct connection 90 with the electronic locks 22 of the lockers 20 of the facility. Through the direct connection 90 (in the example of FIG. 2 a Wi-Fi connection is used), the status of the lockers 20 (free/occupied) is accessible to the central access control unit 40. In this example, the electronic locks 22 have a Wi-Fi module which, in order to save energy, will only turn on sporadically in order to communicate the status of the lock. For example, the electronic lock 22 can communicate the status thereof (open/closed) only when the opening or closing operation of the lock is performed, with the consequent energy savings of the battery of the lock.

In the embodiment of FIG. 2, the mobile device 60 of the user 10 can receive 112 a Wi-Fi connection request sent by the central access control unit 40. If the user 10 accepts the connection, the central access control unit 40 uses said Wi-Fi connection to send a representative image of the lockers 20 of the facility and the possibility that they are occupied or not, depending on the profile user thereof and the access licence 50 granted. The mobile device 60 displays said image on the screen, so that the user can easily identify in the facility the locker or lockers that they have permission to use.

Figure 3:
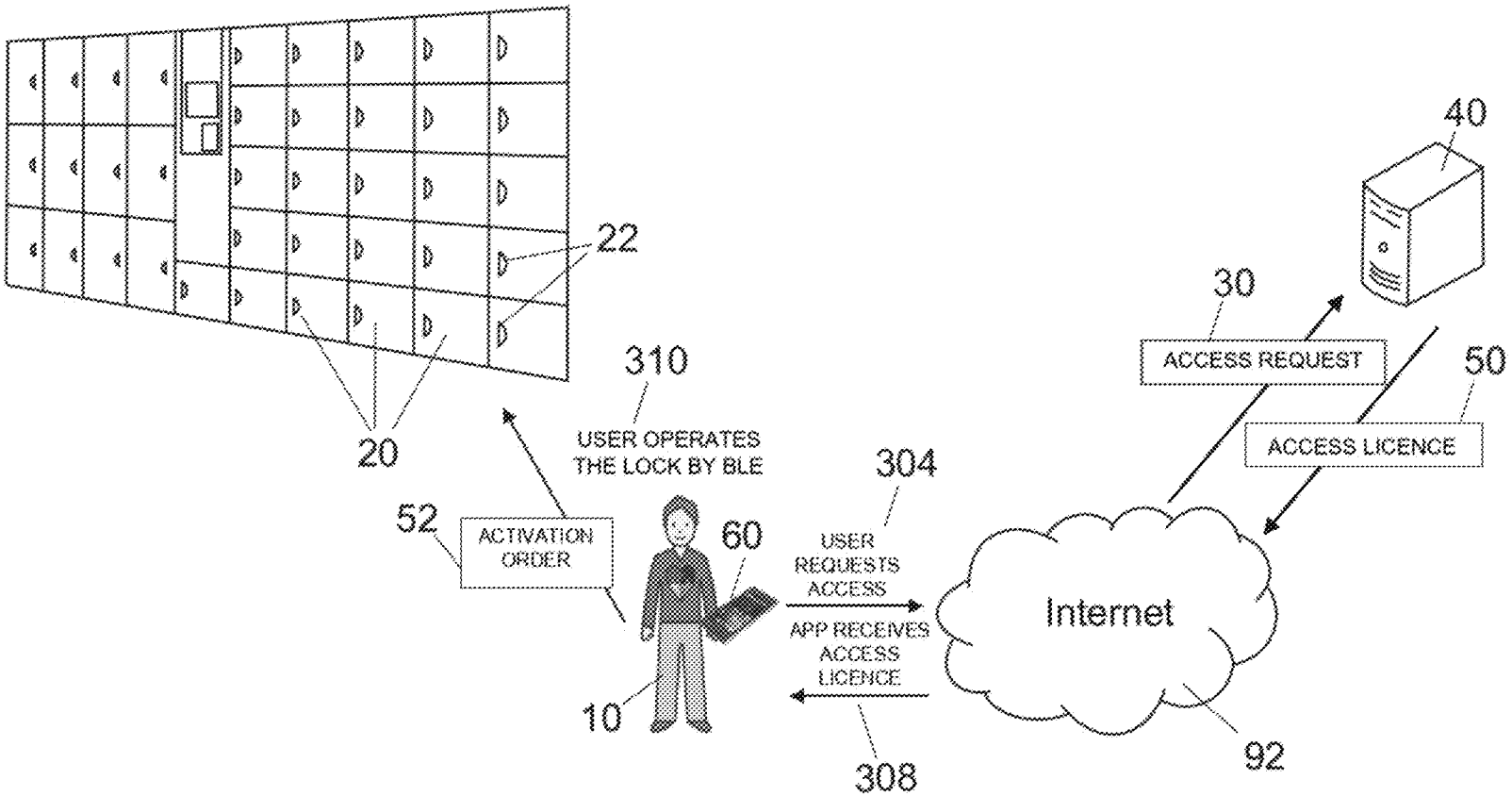
FIG. 3 represents a different embodiment of the invention, wherein the mobile device of a user is connected, through the Internet, to a remote central control unit in order to obtain the activation data of the locks, with which no control equipment is required in the facility where the lockers are located.

In the embodiment of FIGS. 1 and 2, the electronic sending 104 of the access request 30 is performed by the control unit 70 located at the reception 80. However, in the embodiment shown in FIG. 3, the electronic sending 304 of the access request 30 and the obtaining 308 of the access licence 50 with the mobile device 60 is performed directly through a wireless communication 92, for example through an IP connection using the 4G mobile data network or the future 5G network, with the central access control unit 40, without needing to use, as an intermediary entity, a control unit 70 located at the reception 80 of the facility where the lockers 20 are located. The user 10 can then wirelessly operate 310 the electronic locks 22 of the lockers in a manner similar to the one explained above for the embodiment of FIG. 1, establishing a wireless connection by means of BLE and using a dynamic access key obtained in the pairing with the electronic lock 22.

The invention claimed is:

1. A method for activating battery-powered electronic locks of lockers, comprising:

electronically sending to a central access control unit external to the lockers an access request for at least one locker, wherein the access request includes a user profile;

generating, by the central access control unit, an access license in order to operate the electronic lock of at least one locker, wherein the access license includes the user profile and at least one static access key which includes the identifier of the electronic lock of at least one locker, obtaining, by a mobile device, the contents of the access license;

activating, by the mobile device, an electronic lock of a locker by sending a Bluetooth activation signal;

periodically waking up the electronic locks to detect said activation by receiving the Bluetooth activation signal and sending, by the electronic lock as a response to the detected activation, a Bluetooth Low Energy signal containing an identifier of the electronic lock;

receiving, by the mobile device, the Bluetooth Low Energy signal containing the identifier of the electronic lock;

automatically establishing, by the mobile device, a Bluetooth Low Energy pairing with the electronic lock using the received identifier of the electronic lock and the associated static access key contained in the access license; and wirelessly operating, by the mobile device using Bluetooth Low Energy communication, the previously-paired electronic lock of the locker.

2. The method according to claim 1, wherein the electronic sending of the access request is performed by a control unit.

3. The method according to claim 2, wherein the method additionally comprises:

coding, with the central access control unit, the access license in a two-dimensional code;

sending, with the central access control unit, the two-dimensional code to the control unit;

displaying, with the control unit, the two-dimensional code on a screen;

capturing, by using a camera of the mobile device, the two-dimensional code; and decoding the information contained in the two-dimensional code captured in order to obtain the contents of the access license.

4. The method according to claim 1, wherein the electronic sending of the access request and the obtaining of the access license by the mobile device is performed through a wireless communication with the central access control unit.

5. The method according to claim 1, wherein the status of the electronic lockers is accessible to the central access control unit, and wherein the method comprises:

sending, with the central access control unit, a representative image of the lockers and the possibility that they are occupied or not; and representing, on the screen of the mobile device, said image.

6. The method according to claim 1, wherein the wireless operation of the electronic lock of the locker comprises:

obtaining, with the mobile device, the charge level of the battery; and checking, with the mobile device, whether the charge level of the battery is lower than a certain threshold, and in which case sending a low battery warning.

7. The method according to claim 1, wherein the electronic lock of each locker is equipped with an internal clock;

and wherein the wireless operation of the electronic lock of the locker comprises:

obtaining, with the mobile device, the time of the internal clock of the electronic lock;

comparing, with the mobile device, the time of the internal clock of the electronic lock with the time of the clock of the mobile device; and if the difference between both times is greater than a certain threshold, sending to the electronic lock an updated time in order to update the internal clock thereof.

8. A system for activating battery-powered electronic locks of lockers, comprising:

a plurality of electronic locks installed in lockers of a facility, wherein each electronic lock comprises:

a Bluetooth Low Energy communications module, a memory storing a static access key unique for each electronic lock, and a control module configured to periodically wake up to detect an activation of the electronic lock by receiving a Bluetooth activation signal and to send, in response to said detected activation, a Bluetooth Low Energy signal containing an identifier of the electronic lock;

a central access control unit external to the lockers and configured to, upon receiving an access request including a user profile to operate at least one electronic lock, generate and send an access license including the user profile and at least one static access key which includes the identifier of the electronic lock of at least one locker; and a mobile device configured to:

obtain the contents of the access license;

activate an electronic lock by sending a Bluetooth activation signal;

receive, from the electronic lock, the Bluetooth Low Energy signal containing the identifier of the electronic lock;

automatically establish a Bluetooth Lower Energy pairing with the electronic lock using the received identifier of the electronic lock and the associated static access key contained in the access license; and wirelessly operate, by means of Bluetooth Lower Energy communication, the previously-paired electronic lock.

9. The system according to claim 8, comprising a control unit configured to electronically send the access request to the central access control unit.

10. The system according to claim 8, wherein the mobile device is configured to establish a wireless communication with the central access control unit in order to send the access request and obtain the access license.

11. The system according to claim 8, wherein each electronic lock is configured to communicate, to the central access control unit through a Wi-Fi communications module, the status of the electronic lock;

wherein the central access control unit is configured to send, by means of a Wi-Fi communication established with the mobile device, a representative image of the lockers and the possibility that they are occupied or not;

and wherein the mobile device is configured to represent said image on the screen.

12. The system according to claim 8, wherein the mobile device is a smartphone or a smart watch.

13. A system for activating battery-powered electronic lockers, comprising:

a plurality of electronic locks installed in lockers of a facility, wherein each electronic lock comprises:

a Bluetooth Low Energy communications module, a memory storing a static access key unique for each electronic lock, a sensor configured to wake up the electronic lock when detecting an activation of the electronic lock by means of an interaction with the sensor performed by a user; and a control module configured to send, in response to the detected activation, a Bluetooth Low Energy signal containing an identifier of the electronic lock;

a central access control unit external to the lockers and configured to, upon receiving an access request including a user profile to operate at least one electronic lock, generate and send an access license including the user profile and at least one static access key which includes the identifier of the electronic lock of at least one locker; and a mobile device configured to:

obtain the contents of the access license;

receive, from an electronic lock, the Bluetooth Low Energy signal containing the identifier of the electronic lock;

automatically establish a Bluetooth Low Energy pairing with the electronic lock using the received identifier of the electronic lock and the associated static access key contained in the access license; and wirelessly operate, by means of Bluetooth Low Energy communication, the previously-paired electronic lock.

14. The system according to claim 13, wherein the sensor of each electronic lock is a Low Power Card Detection sensor, a capacitive sensor or an infrared sensor.

15. A method for activating battery-powered electronic locks of lockers, comprising:

electronically sending to a central access control unit external to the lockers an access request for at least one locker, wherein the access request includes a user profile;

generating, by the central access control unit, an access license in order to operate the electronic lock of at least one locker, wherein the access license includes the user profile and at least one static access key which includes the identifier of the electronic lock of at least one locker;

obtaining, by a mobile device, the contents of the access license;

activating an electronic lock of a locker, wherein the activation of the electronic lock is manually performed by a user interacting with a sensor of the electronic lock;

waking up, by the sensor, the electronic lock when detecting an activation of the electronic lock;

sending, by the electronic lock as a response to the detected activation, a Bluetooth Low Energy signal containing an identifier of the electronic lock;

receiving, by the mobile device, the Bluetooth Low Energy signal containing the identifier of the electronic lock;

automatically establishing, by the mobile device, a Bluetooth Low Energy pairing with the electronic lock using the received identifier of the electronic lock and the associated static access key contained in the access license; and wirelessly operating, by the mobile device using Bluetooth Low Energy communication, the previously-paired electronic lock of the locker.

16. The method according to claim 15, wherein the sensor of the electronic lock is a Low Power Card Detection sensor, a capacitive sensor or an infrared sensor.

* * * * *